US005236284A

United States Patent [19]

Ilomäki

[11] Patent Number: 5,236,284

[45] Date of Patent: Aug. 17, 1993

[54] DRILLING APPARATUS AND METHOD FOR ITS CONTROL

[76] Inventor: Valto Ilomäki, Loilantie 8, SF-33470 Ylöjärvi, Finland

[21] Appl. No.: 838,797

[22] PCT Filed: Sep. 27, 1990

[86] PCT No.: PCT/FI90/00229

§ 371 Date: Mar. 17, 1992

§ 102(e) Date: Mar. 17, 1992

[87] PCT Pub. No.: WO91/05140

PCT Pub. Date: Apr. 18, 1991

[30] Foreign Application Priority Data

Sep. 27, 1989 [FI] Finland ..... 894559

[51] Int. Cl.[5] ..... E21D 9/00

[52] U.S. Cl. ..... 405/143; 405/141; 405/138

[58] Field of Search ..... 405/138, 140, 141, 142, 405/143, 145

[56] References Cited

U.S. PATENT DOCUMENTS

| | | | |
|---|---|---|---|
| 2,919,121 | 12/1959 | Ruth . | |
| 3,733,835 | 5/1973 | Jacobs | 405/142 |
| 4,122,683 | 10/1978 | Follert et al. . | |
| 4,355,924 | 10/1982 | Hüsemann et al. | 405/141 X |
| 4,640,646 | 2/1987 | Hentschel | 405/141 |
| 5,051,033 | 9/1991 | Grotenhofer | 405/142 X |

*Primary Examiner*—Dennis L. Taylor
*Assistant Examiner*—J. Russell McBee
*Attorney, Agent, or Firm*—Larson and Taylor

[57] ABSTRACT

A drilling apparatus and a method for its control maintains the alignment of a drill head while driving a tunnel. The control is achieved by manipulating the center of gravity of a drill bit unit with respect to a line determined by two supporting points of a protecting tube which are the sole points of the protecting tube supported against the tunnel bottom.

13 Claims, 3 Drawing Sheets

DRILLING APPARATUS AND METHOD FOR ITS CONTROL

BACKGROUND OF THE INVENTION

The invention relates to a drilling apparatus for tunnel drive in soil or rock, the head of which is provided with a working tool, and to a method, wherein the drill head forward advance is controlled by means of a protecting tube.

Previously known is a drilling apparatus provided with one working tool a.o. from the U.S. Pat. No. 4,122,683. In the publication a working tool is described which cuts tunnel front wall through rotation. The excavated material runs into the drill head protecting tube and continues to the rear end of the apparatus. The apparatus has a plurality of grippers taking support from the tunnel walls, by means of which the direction of drilling can be adjusted through supporting the protecting tube against tunnel walls and turning either the tool or the movable drill head, for instance, by means of steering cylinders in a desired direction.

The U.S. Pat. No. 2,919,121 introduces a tunnel driving drilling apparatus by means of which excavated material is conducted to the inside of rotating tube. Outside this tube there is also the actual protecting tube enveloping the drill head portion. This tube is supported against the tunnel wall by means of wheels and expanding ring segments, and the direction of the apparatus is effected by these wheels and segments.

The disadvantage of the above solutions is the access of drill waste to the tunnel bottom during the drilling process, allowed by the placement of tool bit portions with relation to the protecting tube. A space is left open between drill bits and the protecting tube, and thus excavated waste simply piles up in this space. It is rather complicated to force the material inside the protecting tube or the conveying tube and not quite possible even on driving a tunnel in unbroken rock.

Due to the fact that a certain quantity of waste always remains in the tunnel in these cases, the alignment of drill head is disturbed since steering is effected through support from the tunnel wall. Especially in the lower tunnel parts, harmful drill waste is left, wedging itself between the protecting tube and the tunnel.

SUMMARY OF THE INVENTION

By means of the method and apparatus of this invention a crucial improvement of said disadvantages is achieved. In order to put this into practice, the method and apparatus according to the invention include two adjustable sliding elements supported against the tunnel bottom and position the center of gravity of the drill bit unit in the area between where these two elements are supported.

It can be considered the main advantage of this invention that the drill head rests steadily against the inner surface of the waste-free tunnel, whereby a simple direct forward drill head without any control equipment can be used. The solution according to this invention is preferably applied to tunnels with small-sized diameters, 800 mm at the best. The advantage of the invention is further increased by the fact that it is difficult to provide drill heads with small-sized diameters when control equipment is included.

BRIEF DESCRIPTION OF THE DRAWING

In the following, the invention is more closely described with reference to the enclosed drawings where.

DETAILED DESCRIPTION OF THE PREFERRED EMBODIMENTS

Figure 1:
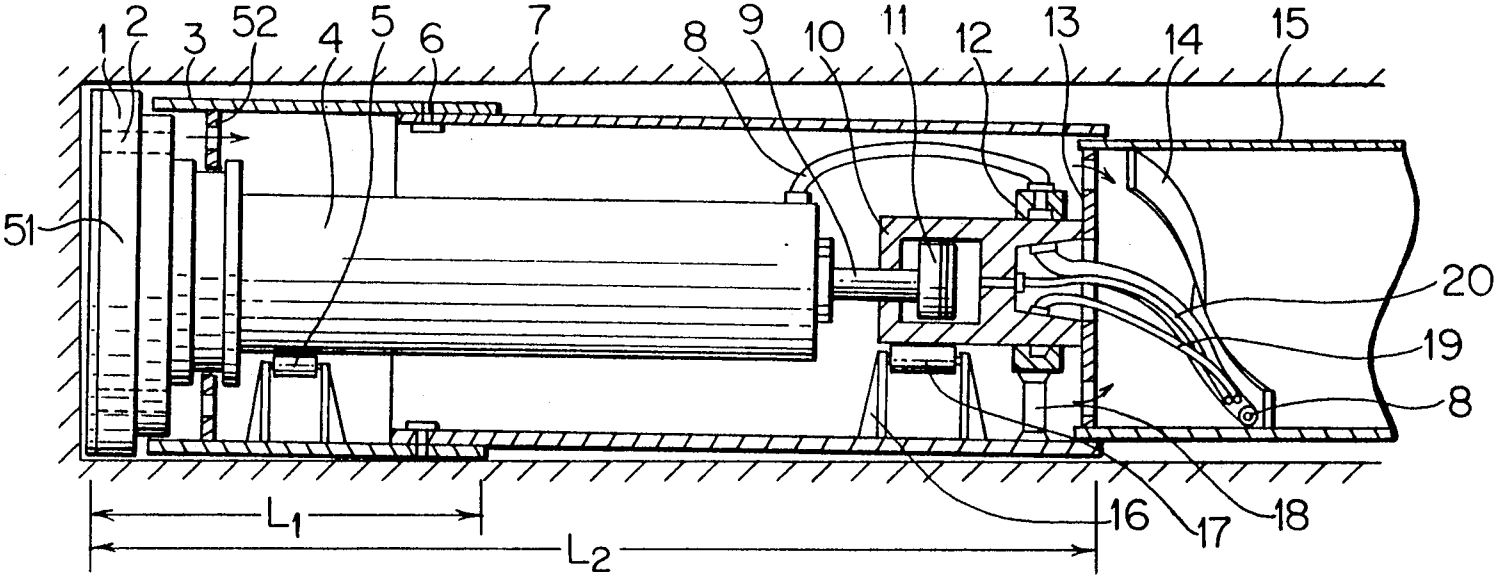
FIG. 1 is a drill head with tool.
Figure 3:
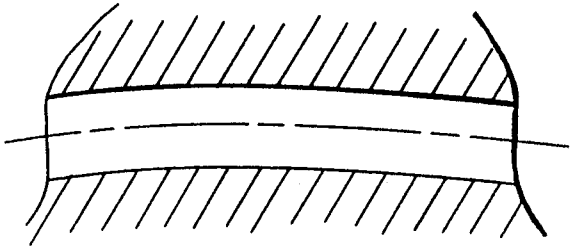
FIGS. 2 and 3 are tunnels curved in the vertical plane.
Figure 2:
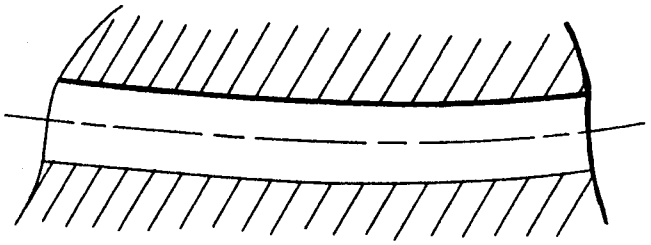

FIG. 1 shows a tool (4) provided with a bit (1), bit holder (51) and openings (2), along which drill waste is conducted by means of compressed air from bit front to protecting tube (3, 7). Compressed air enters the tool over a pipe (8) and at least a part of the air is conducted to the bit front to convey drill waste. Between bit holder (51) and the protecting tube enveloping it, there is a lap joint preventing access of drill waste to the outside of the protecting tube. Through placement and directioning of openings (2), an ejector effect can be created in the lap joint so that even the drill waste can be sucked up in the protecting tube, which most probably would have passed the bit. A collar ring (52) fitted with openings is attached to the protecting tube and is, on the other hand, also in the groove in the tool, whereby it secures the lap joint as the drill bit is in operation.

The protecting tube contains two components, one of which (7) is fixed to the other (6) by screws. The tool is supported by rolls (5, 17) against the protecting tubes. The hydraulic cylinder (10), piston (11) and piston rod (9) function as a thrust bearing. A rotating conveyor tube (15) provided with ribbing (14), transmits the rotary motion and conveys drill waste, and the compressed-air hose and the hydraulic hoses (19, 20) for the drill head are arranged behind the ribbing. Compressed air is conducted over a rotating tube by means of a collector ring (12) to an immobile tube. The collector ring is supported against the protecting tube by means of supporting parts (18).

Figure 4:
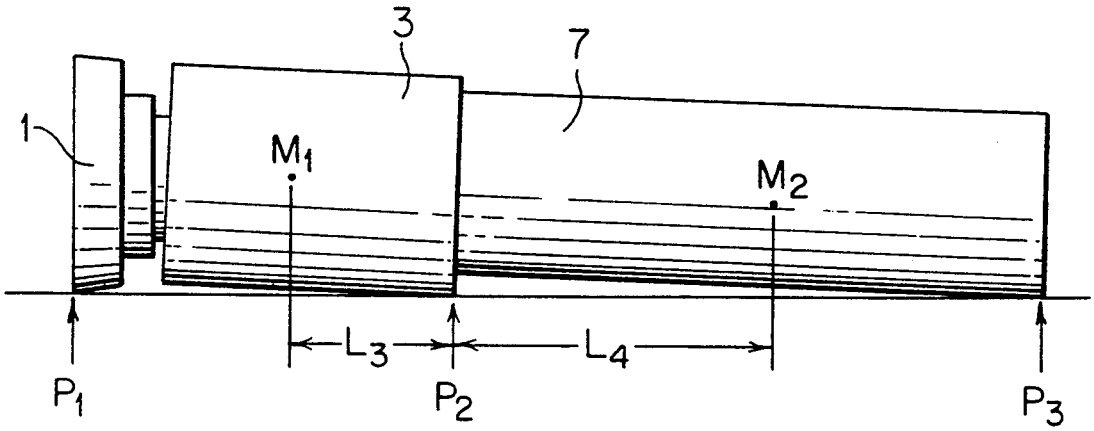
FIG. 4 is a drilling apparatus steered by the force of gravity.

FIG. 4 shows a protecting tube and tool (1) provided with a collar ring or comprised of two protecting tubes (3,7) with different diameters. On drilling, the protecting tube rests on the tunnel bottom supported by points P2 and P3. If the tip point P1 of the drill bit (1) is adjusted to the same line as P2 and P3, the apparatus travels straight forward. Condition for straight forward advance is the fact that, with respect to support point P2, the apparatus is heavy at the back. Thereby moment $M2 \times L4$ must be greater than moment $M1 \times L3$. M1 and M3 are forces by means of which both drill head parts are attracted to the earth by gravitation. M1 and M2 are placed in the center of gravity of parts, the distances of which are L3 and L4 reckoned from point P2. Through shifting any of the points P1, P2 or P3 in the vertical plane off the line determined by two other points, it is possible to arrange the drilling apparatus to make tunnels curved in the vertical plane.

Figure 5:
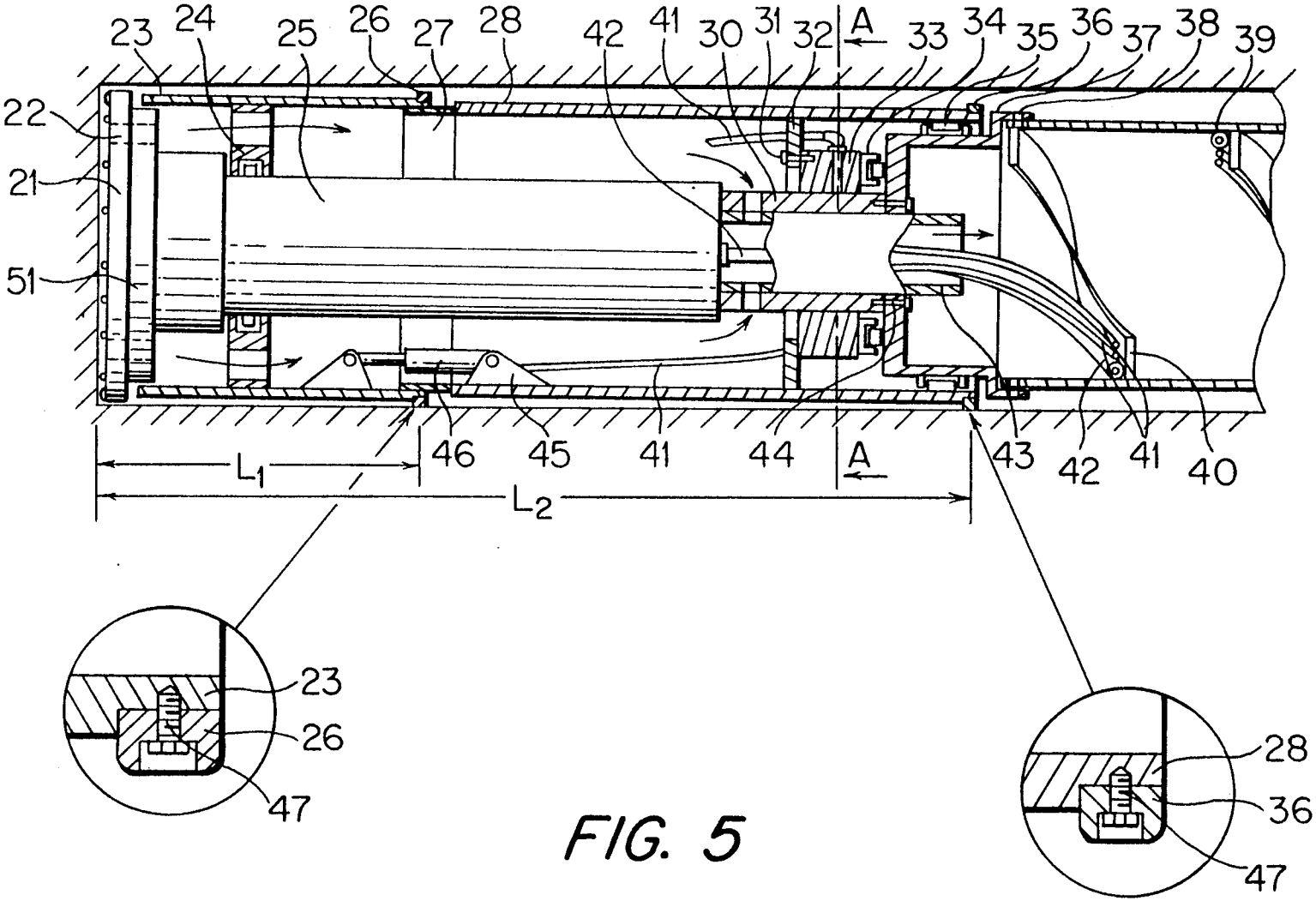
FIG. 5 is a drilling apparatus leaning against the tunnel bottom on bearing surfaces.

FIG. 5 shows a compressed-air driven tool (25) provided with a bit (21) and bit holder (51). Compressed air is conducted also to the drill bit front, from where it is distributed through bit openings (22) to the inside of protecting tubes (23, 28) while conveying drill waste. The tool head is secured by a bearing support (24). Adjusting rings (26,36) are fitted with screws (47) to points of support leaning against the tunnel bottom. In the protecting tube lower surface adjustment rings of different height or just bracings can be used. The interplacement of the protecting tubes can be modified with turning cylinders (46) attached to the protecting tubes with holders. The rotary movement to the tool is transmitted by means of the conveying tube (39). The tube has an intern ribbing (40) behind which the compressed-air hose (42) and hydraulic hoses (41) are arranged. A tubular part (37) is fitted to the conveyor tube (39) front edge with brackets (38), the front face of which functions as pressure bearing surface, the shell surface of which functions as a radial bearing surface. The rotary motion is transmitted from said part to the tool by means of a bushing (30). The inner bushing (43), inside of which drill waste is transmitted to the conveying tube is also rotatable. A hydraulic pressure distributor (33) is secured around the bushing (30) by means of a collar ring (33). The rollers (34) function as thrust bearing and the rollers (35) as radial bearing.

Figure 6:
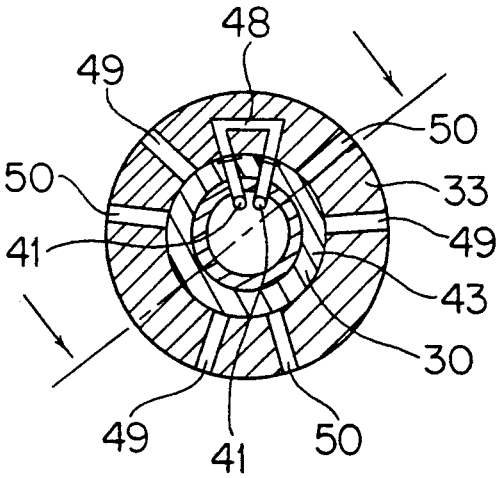
FIG. 6 is the cross-section of a hydraulic pressure distributor.

FIG. 6 shows a cross-section of the hydraulic pressure distributor. Bushings (43) and (30) rotate together and through them, from the inside to the outer circumference, hydraulic fluid channels are taken. Interplacement of tool and protecting tube owing to torsion, can be prevented through rotating the conveying tube, whereby the bushings (30, 43) in the distributor also are rotating. Into one of the hydraulic fluid channels (41) relatively low pressure of ab. 5 bar is conducted and as soon as the position shown in the figure is reached, corresponding pressure can be observed from the other hydraulic channel (41). Then the position of the distributor outer ring (33) is known, and when known at which angle the pressure hoses and their channels (49,50) are in the distributor ring, all steering cylinders can be steered individually through rotating the channels of the distributor bushings and the channels of the turning cylinders to match each other.

The invention is not restricted to the embodiment introduced in the description and drawings but it can be modified within the limits of the patent claims.

I claim:

1. A method for control of a drilling apparatus driving a tunnel by means of one working tool comprising the steps of:

determining a line between two sole supporting points P2 and P3 of a protecting tube leaning against the tunnel bottom;

arranging the center of gravity of a bit unit of said drilling apparatus on the area between two planes, each being perpendicular to said tunnel bottom and running through one of said sole supporting points P2 and P3; and controlling said drilling apparatus by varying the position of said center of gravity of said bit unit with respect to said determined line.

2. A method according to claim 1 wherein said controlling step includes aligning said supporting points P2 and P3 and a drill bit tip point P1 with the same line which is the desired straight bottom line of the tunnel.

3. A method according to claim 1 wherein said controlling step includes making curved tunnels in the vertical plane level by excluding a drill bit tip point P1 from the line formed by said supporting points P2 and P3.

4. A method according to claim 1, wherein said controlling step includes deviating one of said supporting points P2, P3 and a drill bit tip point P1 from a line running through the remaining, undeviated two points, using turning cylinders.

5. A method according to claim 4 wherein pressure to said turning cylinders is supplied by a rotating pressure distributor.

6. A method according to claim 4 wherein the amount of deviation generated by said turning cylinders is found by means of a rotating pressure distributor.

7. A method according to claim 1 wherein said controlling step includes deviating at least one of said supporting points P2 and P3 from a line formed by said supporting points and a drill bit tip point P1 using replaceable sliding elements.

8. A method according to claim 1 wherein said controlling step includes deviating at least one of said supporting points and a drill bit tip point from a line running through said supporting points and said drill bit tip point, by modifying the distances between at least two points selected from the group of said supporting points and said drill bit tip point.

9. A drilling apparatus having one working tool for driving a tunnel, comprising:

a protecting tube system, which supports said drilling apparatus in advancing on the tunnel bottom, said protecting tube system including two adjustable sliding elements each of which includes one of the sole supporting points P2 and P3 for said protecting tube system against the tunnel bottom; and a drill bit unit, wherein the center of gravity of said drill bit unit is on the area between two planes, each being perpendicular to said tunnel bottom and running through one of said sole supporting points.

10. A drilling apparatus according to claim 9 wherein said adjustable sliding elements to be used in said protecting tube system as said sole supporting points P2 and P3 are rings with an adjustable height.

11. A drilling apparatus according to claim 9 further comprising:

turning cylinders for turning the drill head; and a rotating pressure distributor for conducting pressure individually to each turning cylinder.

12. A drilling apparatus according to claim 11, wherein said rotating pressure distributor includes a channel part for detection of the status of rotation in order to conduct pressure directly to a return hose.

13. A drilling apparatus according to claim 9, wherein said two adjustable sliding elements are tubes, one of said tubes being fixed inside the other tube, each of said tubes providing one of said sole supporting points P2 and P3.

* * * * *